United States Patent [19]

Bardsley

[11] Patent Number: 4,739,717

[45] Date of Patent: Apr. 26, 1988

[54] TUFTING MACHINE GAUGE PARTS MODULE

[75] Inventor: H. Brian Bardsley, Near Chorley, England

[73] Assignee: Spencer Wright Industries, Inc., Dalton, Ga.

[21] Appl. No.: 65,576

[22] Filed: Jun. 23, 1987

[30] Foreign Application Priority Data

Aug. 16, 1986 [GB] United Kingdom ..... 8620016

[51] Int. Cl.[4] ..... D05C 15/06

[52] U.S. Cl. ..... 112/80.5; 112/80.53

[58] Field of Search ..... 112/80.5, 80.51, 80.52, 112/80.53

[56] References Cited

U.S. PATENT DOCUMENTS 4,303,024 12/1981 Bardsley ..... 112/80.52

4,313,388 2/1982 Biggs et al. ..... 112/80.53

*Primary Examiner*—Ronald Feldbaum

*Attorney, Agent, or Firm*—Alan Ruderman

[57] ABSTRACT

A hook module for use in a tufting machine has a molded body member including a plurality of tufting machine hooks cast therein in side-by-side relationship. The hooks have a bill at one end, a blade extending from the bill to a shank and a mounting portion of the shank extending remote from the bill. The mounting portions of the shanks extend to the rear surface of the body member so as to prevent divergence of the bills after the body member has been cast about the mounting portions and adjacent portions of the shanks. The hooks are constructed from tungsten carbide which precludes their bending to provide the requisite parallelism of the bills as is possible with bendable hooks in prior art modules not requiring the mounting portions to extend to the rear surface.

11 Claims, 1 Drawing Sheet

TUFTING MACHINE GAUGE PARTS MODULE

BACKGROUND OF THE INVENTION

This invention relates to tufting machines and more particularly to tufting machine gauge parts, specifically tufing machine hook mounting arrangements.

It is known in the art to provide tufting machine hooks in modular form, i.e., a plurality of hooks being arranged in sensibly parallel spaced disposition in a common cast body. Modules of this type are illustrated in Bardsley U.S. Pat. No. 4,303,024 dated Dec. 1, 1981, and Slattery U.S. Pat. No. 4,397,249 dated Aug. 9, 1983, both patents being assigned to the assignee of the present invention. Although these hook modules have proved satisfactory in use, it appears that a differential shrinkage between portions of the cast body results in a mutual divergence of the hooks from the body such that parallelism is destroyed. It thus becomes necessary after casting to adjust the hooks, as by bending, to achieve the requisite degree of parallelism therebetween and an acurate pitching out of the hook bills where they must cooperate with mating needles. Although this additional step in forming the module may present some inconvenience, it is readily and easily accomplished with conventional carbon steel and steel alloy hooks since they have the requisite bending qualities.

To improve the wear characteristics of tufting machine hooks which, of course, engage respective needles during each cycle, which may be 1200 times each minute, and in the case of cut pile tufting machines also likewise engage respective knives, materials such as tungsten carbide may be utilized. However, the poor bending qualities of tungsten carbide has to date precluded the use of this material in constructing hooks for use in cast modular bodies. When differential shrinkage occurs, the hooks cannot be bent back into parallelism.

SUMMARY OF THE INVENTION

Consequently, it is a primary object of the present invention to provide a hook module wherein the incidence of non-parallelism between adjacent hooks is minimized and inherent pitching accuracy is imparted.

It is another object of the present invention to provide a hook module for tufting machines wherein tungsten carbide hooks may be molded within the body of the module while maintaining the parallel relationship established prior to casting.

Accordingly, the present invention provides a hook module for use in the tuft forming instrumentalities of a tufting machine and comprising a body having a plurality of tufting machine hooks cast integrally therewith, and the module is characterized in that the shanks of the respective hooks extend through or substantially through the full extent of the body in the longitudinal direction of the hooks, so that the differential shrinkage effects of conventional modules, which effects give rise to a degree of divergence of the hooks, are avoided.

By engaging substantially the entire shank with the body the shrinkage which occurs in the body during cooling of the casting material is substantially equal along the length of the hooks and the divergent fanning out of the blades and bills of the hook is precluded.

BRIEF DESCRIPTION OF THE DRAWINGS

The particular features and advantages of the invention as well as other objects will become apparent from the following description taken in connection with the accompanying drawings, in which:

FIG. 2 being a section along line 2—2 of FIG. 3.

DESCRIPTION OF THE PREFERRED EMBODIMENT

Figure 1:
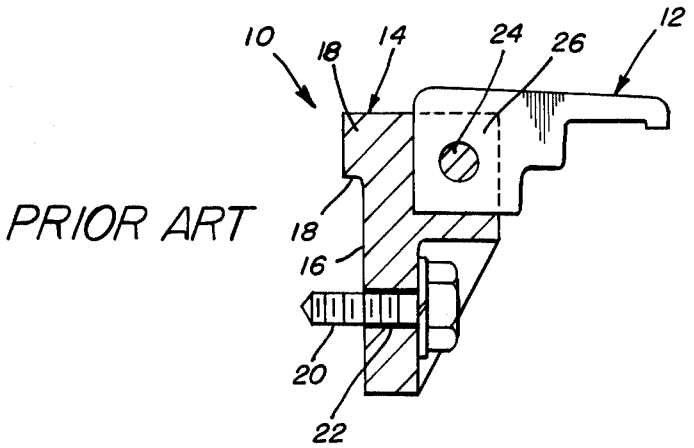
FIG. 1 is a diagrammatic cross-sectional view taken through a conventional hook module.

Referring now to FIG. 1, a known form of hook module 10 such as that illustrated in the aforesaid patents of Bardsley and Slattery is illustrated. The module comprises a plurality of hooks 12 cast integrally in side-by-side disposition within a common body 14. The body 14 has a datum surface 16 including a lip 18 for engaging with a hook bar (not shown) and is secured to such bar by a bolt 20 which engages through hole 22. The hooks 12 extend outwardly from the body 14 and each such hook is apertured, as at 24, to permit passage therethrough of the casting material, thus to promote retention of the hook in the body.

It has been found that in modules constructed as illustrated in FIG. 1 the hooks exhibit a tendency to diverge or fan slightly outwardly of the cast body, and the degree of parallelism necessary for satisfactory cooperation with the other tuft-forming instrumentalities, e.g., needles and knives, can be achieved only by adjustment, as by bending of the hooks into a requisite relationship. The slight divergence of the hooks 12 is thought to be the result of a differential shrinkage of the body 14 as between the region 26 thereof wherein the hooks 12 are embedded and the region 28 of the body rearwardly of the hooks.

Figure 3:
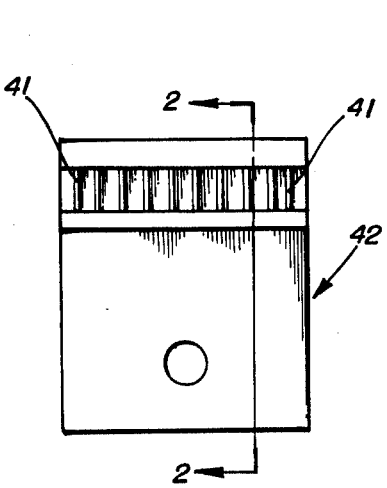
FIG. 3 is a rear elevational view thereof.
Figure 2:
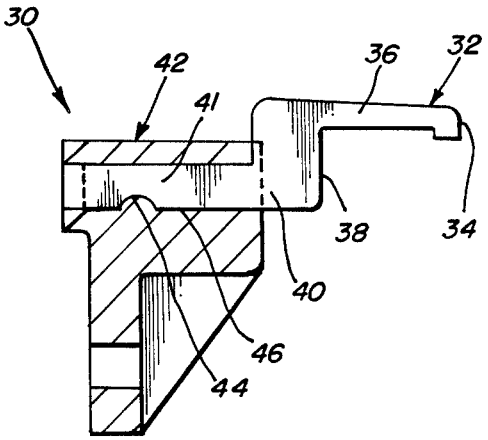
FIG. 2 is a view similar to FIG. 1, but of a module incorporating the principles of the present invention.

The present invention seeks to avoid the mutual divergence, or "fanning" of the hooks, and proposes a module constructed as illustrated in FIGS. 2 and 3.

Referring to FIG. 2, in accordance with the principles of the present invention, a module 30 is proposed having a hook 32 substantially similar to conventional tufting machine hooks. The hook 32 has a bill 34 at the free end thereof for entering and seizing a loop presented by a needle in the tufting machine, a blade 36 extending rearwardly, a throat 38 at the rear of the blade, and a shank 40 extending rearwardly from the throat 38 remote from the bill and includes a mounting portion 41. That part of the hook 32 including the entire mounting portion 41 and a portion of the shank 40 which engages the body member 42 extends fully through the body member 42 in the longitudinal direction of the hooks, the ends of the shanks being seen at the rear of the body member, as illustrated in FIG. 3. Thus, the possibility of shrinkage of the body member of a kind such as might give rise to "fanning" of the hooks is precluded.

The hook 32, which typically may be of a highly alloyed steel preferably is tungsten carbide having adequate strength and hardness for use in the context of a tufting machine, and a semi-circular or similar detent 44 is provided at one of the longitudinal edges, such as the lower edge 46, of the mounting portion 41 of the shank 40 to retain the same in position within the body member 42.

The body member may be cast from a material which is commonly used in the art, a preferred such material being a low melting point alloy of zinc/lead/aluminum available under the trademark MAZAC.

It has been found that a module constructed in accordance with the present invention does not exhibit any divergence as between adjacent hooks, and thus avoids the need for subsequent adjustment as by bending or "twitching" of the hooks into substantial parallelism, thereby providing a module which may incorporate hooks of tungsten carbide.

While the primary purpose of having that part of the hook which is embedded in the body member extend fully through the body member is to avoid adverse shrinking effects of the body member on the parallelism of the side-by-side hooks, a further benefit arises from such configuration in that retrieval of a hook from the module on "drilling out" material in registration with the detent 44 allows such hooks to be removed by a push/pull movement, i.e., a push from the rear and a pull from the front, such movement not being possible with the prior art structure. In such case the defective hook may be removed and replaced readily in the body member.

Numerous alterations of the structure herein disclosed will suggest themselves to those skilled in the art, However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, What is claimed herein is:

1. A hook module for use in a tufting machine comprising, a cast metal body member, a plurality of tufting machine hooks, each hook having a shank including a mounting portion at one end, a blade extending from the shank to define a throat therebetween and terminating at a bill remote from said mounting portion, the mounting portions of said shanks being molded into said body member in spaced side-by-side disposition and extending through said body member with the ends of the mounting portions being visible at a surface of the body member remote from the bills, and retaining means formed on the mounting portions for securely retaining said hooks in the body member.

2. A hook module as recited in claim 1, wherein said hooks comprise tungsten carbide.

3. A hook module as recited in claim 1, wherein said retaining means comprises a detent in an edge of said mounting portion.

4. A hook module as recited in claim 3, wherein said hooks comprise tungsten carbide.

5. A hook module as recited in claim 1, wherein a portion of said shank in addition to said mounting portion is molded into said body member.

6. A hook module as recited in claim 5, wherein said hooks comprise tungsten carbide.

7. A hook module as recited in claim 6, wherein said retaining means comprises a detent in an edge of said mounting portion.

8. A hook module as recited in claim 1, wherein said body member has a datum surface remote from said bills, said datum surface having a lip extending therefrom and terminating in a rear surface beyond said datum surface removed from said bills, the ends of said mounting portions extending to said rear surface.

9. A hook module as recited in claim 8, wherein said hooks comprise tungsten carbide.

10. A hook module as recited in claim 9, wherein said retaining means comprises a detent in an edge of said mounting portion.

11. A hook module as recited in claim 10, wherein a portion of said shank in addition to said mounting portion is molded into said body member.

* * * * *